US011428500B2

(12) United States Patent
Langley

(10) Patent No.: US 11,428,500 B2
(45) Date of Patent: Aug. 30, 2022

(54) ARCHERY RELEASE AID

(71) Applicant: Bear Archery, Inc., Evansville, IN (US)

(72) Inventor: Timothy W. Langley, McDaniels, KY (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 17/301,083

(22) Filed: Mar. 24, 2021

(65) Prior Publication Data

US 2021/0318094 A1 Oct. 14, 2021

Related U.S. Application Data

(60) Provisional application No. 63/008,887, filed on Apr. 13, 2020.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 5,067,472 A 11/1991 Vogel et al.
6,460,529 B2 10/2002 Pullin
6,584,966 B1 7/2003 Summers et al.
6,631,709 B2 * 10/2003 Carter ..... F41B 5/1469 124/35.2
6,647,976 B2 11/2003 Summers et al.
6,953,035 B1 * 10/2005 Summers ..... F41B 5/1469 124/35.2
7,574,999 B2 8/2009 Pardoski, Jr.
7,581,536 B2 9/2009 Porter
8,869,781 B2 10/2014 Jones
9,027,540 B2 5/2015 Springer
9,250,032 B2 2/2016 Kelly et al.
9,255,762 B2 2/2016 Kelly et al.
9,261,323 B2 2/2016 Springer
9,285,183 B2 3/2016 Rentz
9,429,384 B2 8/2016 Whalen
9,557,133 B2 1/2017 Rentz
9,612,077 B2 4/2017 Kelly
9,618,295 B1 4/2017 Rentz
9,625,230 B2 4/2017 Kelly et al.
9,702,658 B2 7/2017 Horn
(Continued)

*Primary Examiner* — John A Ricci

(74) *Attorney, Agent, or Firm* — Woodard, Emhardt, Henry, Reeves & Wagner, LLP

(57) ABSTRACT

A back tension archery release aid including a rotatable safety release lever. The safety release lever is engaged and operated by the outer fingers of an archer. Once an archer achieves full draw, the release lever is operated by the archer's outer fingers to lock a portion of a release head assembly in place. Further rotation of the release releases the bowstring and fires an arrow. Certain back tension release aid embodiments include magnets which assist in holding a sear and bridge together within the release head assembly prior to releasing an arrow and assist in resetting the release after an arrow is released.

18 Claims, 19 Drawing Sheets

(56) References Cited

U.S. PATENT DOCUMENTS

| | | | | |
|---|---|---|---|---|
| 9,857,139 | B2 | 1/2018 | Kelly et al. | |
| 9,863,736 | B2 | 1/2018 | Kelly et al. | |
| 9,891,019 | B2 | 2/2018 | Haas et al. | |
| 9,970,731 | B2 | 5/2018 | Horn | |
| 9,982,961 | B1 | 5/2018 | Rentz | |
| 10,012,467 | B2 | 7/2018 | Meadows | |
| 10,145,646 | B2 | 12/2018 | Kelly | |
| 10,240,887 | B1 | 3/2019 | Henry | |
| 10,281,231 | B2 | 5/2019 | Springer | |
| 10,488,145 | B2 | 11/2019 | Haas et al. | |
| 2003/0154969 | A1* | 8/2003 | Carter | F41B 5/1469 124/78 |
| 2017/0089663 | A1 | 3/2017 | Horn | |
| 2019/0186864 | A1 | 6/2019 | Horn et al. | |
| 2019/0265000 | A1 | 8/2019 | Haas | |

* cited by examiner

ARCHERY RELEASE AID

FIELD OF THE INVENTION

The present disclosure relates generally to archery and particularly to a release aid to assist an archer to draw and release the bowstring of an archery bow.

BACKGROUND OF THE INVENTION

The traditional manner for an archer to pull the bowstring of an archery bow is using the archer's fingers. Alternately, archers often use accessories called releases or release aids which hold and then release the bowstring when a trigger or similar lever is pulled by the archer. Many common releases use a caliper system with a pair of jaws which pinch together around the bowstring or around a "D" loop on the bowstring. The caliper jaws are opened by pulling a trigger.

A less common type of archery release is sometimes called a back tension release. In archery a common problem for archers is target panic. One accepted way to combat target panic is to use a back tension style release. In contrast to a caliper or a trigger style release, a back tension release involves a two stage process for drawing and releasing the bowstring and does not use a trigger.

In the first stage, the release is hooked onto the bowstring or bowstring loop and pulled rearward to the draw position. During this phase the release head assembly will not operate to release the bowstring. In some current versions of a back tension release, once the archer achieves full draw, the archer toggles a thumb-triggered safety release which causes a portion of the release head assembly to be locked in place, as illustrated in U.S. Pat. No. 6,953,035.

In the second stage, after the safety is released, upon rotation of the release handle in a lateral plane the remaining portions of the release head assembly rotate relative to the locked portion. This frees the hook to rotate, allowing the hook to release the bowstring.

SUMMARY

The present disclosure is directed to back tension style release aids usable for drawing and releasing a bowstring. In the first stage, the release is hooked onto the bowstring or a "D" loop on the bowstring and pulled rearward to the draw position. Once the archer achieves full draw, upon manual rotation of the release handle the release head assembly rotates relative to a locked portion, thereby allowing a hook piece to rotate and to release the bowstring, e.g. a firing event. Certain embodiments of a back tension release as disclosed include a pair of magnets creating an attraction force in the release head. Separately, certain embodiments of a back tension release as disclosed include a release lever arranged to engage and be operated by the archer's outer fingers, most typically the fourth and/or pinky fingers of the archer's hand.

In one embodiment, the release aid includes a handle having an inward end with one or more grooves to receive an archer's inward finger, namely the first or index finger, an outward end with one or more grooves to receive one or more of an archer's outer fingers, namely the third, fourth, and/or pinky fingers, and a post section extending forward from the handle and arranged intermediate the inward end and the outward end. As used herein, the inward end is typically extending toward and closer to the archer's body while the outward end generally extends away from the archer's body during use. The post section defines a central bore, which houses a movable spring pin.

The release aid further includes a release lever pivotally connected to and extending from the outward end of the handle. In some embodiments, the release lever has an outward end with one or more grooves to receive one or more of an archer's outer fingers, namely the third, fourth, and/or pinky fingers. The release lever generally includes an inwardly extending lever arm portion. The lever arm portion is operable to advance the spring pin forward within the central bore.

Pivotally mounted to a forward end of the post section is a release head assembly. The release head assembly has a hook piece for selectively retaining an archery bow bowstring while the bow is drawn. Generally, forward advancement of the spring pin blocks rotation of a portion of the release head assembly to facilitate firing of the archery bow.

In certain embodiments, the release aid includes a pair of magnets housed within the release head assembly. In one example, the pair of magnets includes a first magnet housed within a sear body and a second magnet housed within an upper portion of a bridge. Generally, the first and second magnets are arranged with opposite polarities to facilitate an attraction force. The magnetic attraction force of the magnets minimizes the risk of an unintentional release by maintaining a connection between the sear body and bridge. The magnetic connection between the sear body and bridge can be overcome when sufficient rotational force is placed on the release lever. Additionally, the magnetic force biases the bridge and hook piece to reconnect with the sear body after the bowstring is released, forming an automatic reset mechanism.

In a further embodiment, the release aid may include one or more set screws. In one example, the one or more set screws include a first set screw and a second set screw housed in the release lever. The one or more set screws may be used by an archer to modify the position of the release lever portion to reduce or increase the amount of rotation needed to release the bowstring.

In yet other embodiments, the release aid includes straight and swept back release lever versions to allow an archer with large hands to select a release lever to fit an archer's hands.

Additional objects and advantages of the described embodiments are apparent from the discussions and drawings herein.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

In contrast to a caliper or a trigger style release, a back tension release does not use a trigger. Instead it involves a two stage process for drawing and releasing a bowstring. In the first stage, the release is hooked onto the bowstring or a "D" loop on the bowstring and pulled rearward to the draw position. Optionally some back tension releases include a safety so that during the draw phase the release head assembly will not operate to release the bowstring. Once the archer achieves full draw, if present the archer may toggle a safety release which locks a portion of the release head assembly in place. Thereafter, upon manual rotation of the release handle, the remaining portions of the release head assembly rotate relative to the locked portion, thereby allowing a hook piece to rotate and to release the bowstring. In contrast to a thumb-operated safety release style, certain embodiments of a back tension release as disclosed include a safety release lever arranged to engage and be operated by the archer's outer fingers, typically the fourth and/or pinky fingers of the archer's hand.

Figure 1:
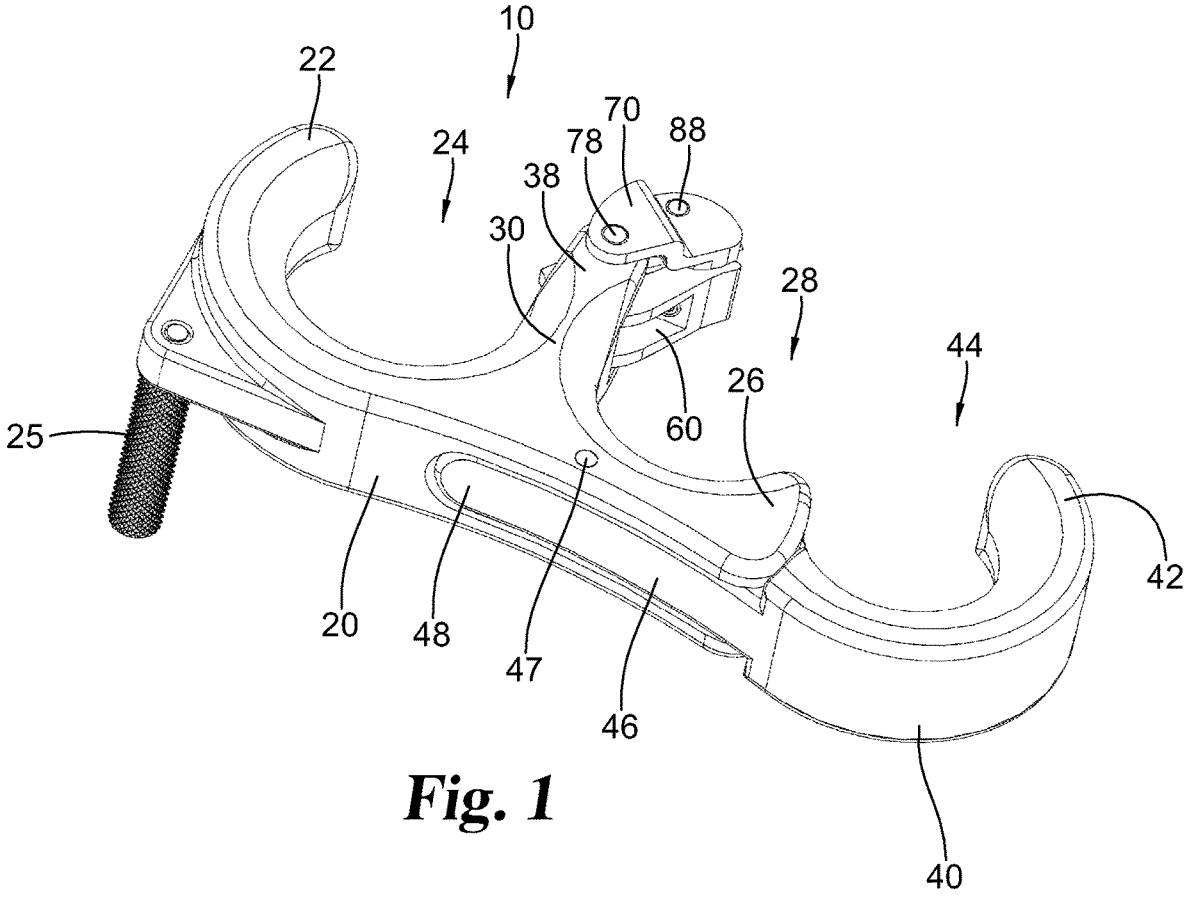
FIG. 1 is a perspective view of an archery release aid illustrating an embodiment of the present disclosure.
Figure 2:
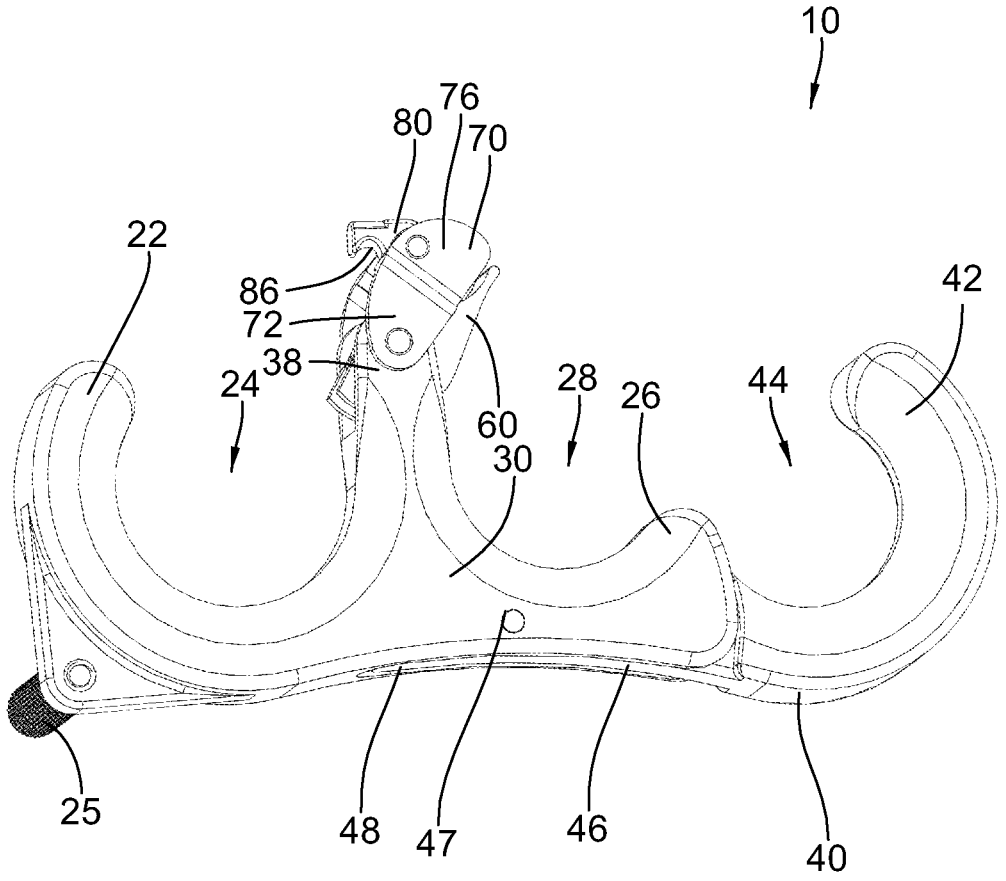
FIG. 2 is a side view of the archery release aid of FIG. 1.
Figure 3:
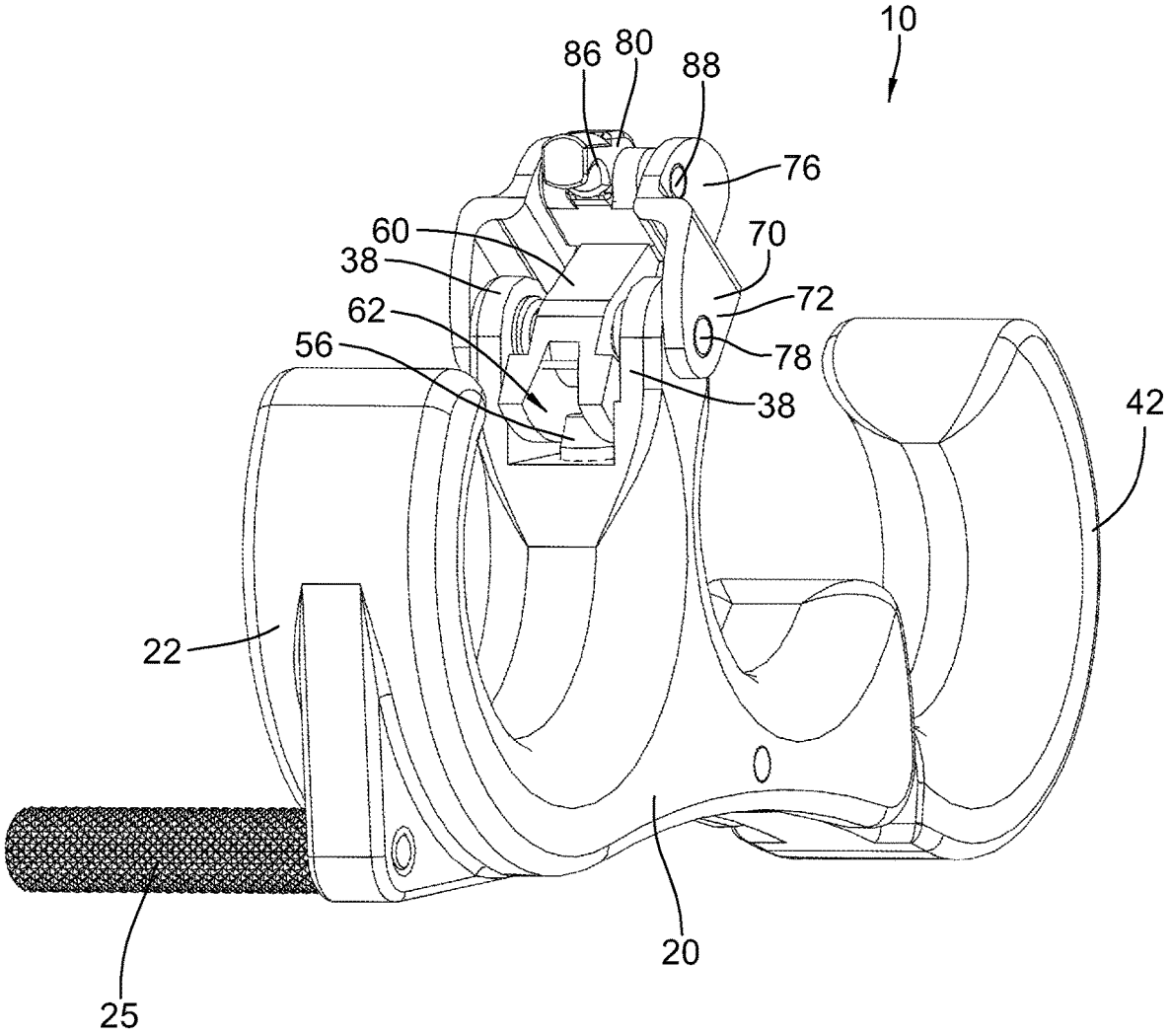
FIG. 3 is an end perspective view of the archery release aid of FIG. 1.

FIGS. 1-3 illustrate exterior views of a representative embodiment of archery release aid 10. Release aid 10 includes a handle 20. Handle 20 includes an inward end 22 defining an opening and groove 24 for an archer's first or inward finger, such as the archer's index finger. Optionally a non-operative thumb rest 25 may be included for comfort and to assist the archer in holding and maneuvering handle 20. Handle 20 further includes an outward end 26. Release lever 40 extends rearward from handle outward end 26. Release lever 40 includes an outward end 42. Handle outward end 26 and release lever outward end 42 define openings and grooves 28 and 44 for placement of the archer's outer fingers, namely the archer's third, fourth and/or pinky fingers. Most typically at least the archer's third finger will remain on the handle outward end and at least one of the archer's fourth or pinky fingers will be on the release lever.

A central pillar or post section 30 is arranged intermediate the length of handle 20 and extends forward toward the bowstring during use. Post section 30 is arranged between the opening and groove 24 for an archer's inward finger and the opening and groove 28 for an archer's outward fingers. A pair of parallel opposing flanges or plate portions 38 extend from the forward end of post section 30. A release head assembly is pivotally mounted to the forward end of post section 30 between plate portions 38. The release head assembly primarily includes sear body 60, bridge 70 and hook piece 80. The distal end of hook piece 80 defines a hook groove 86 to engage a bowstring or D-loop.

Figure 4A:
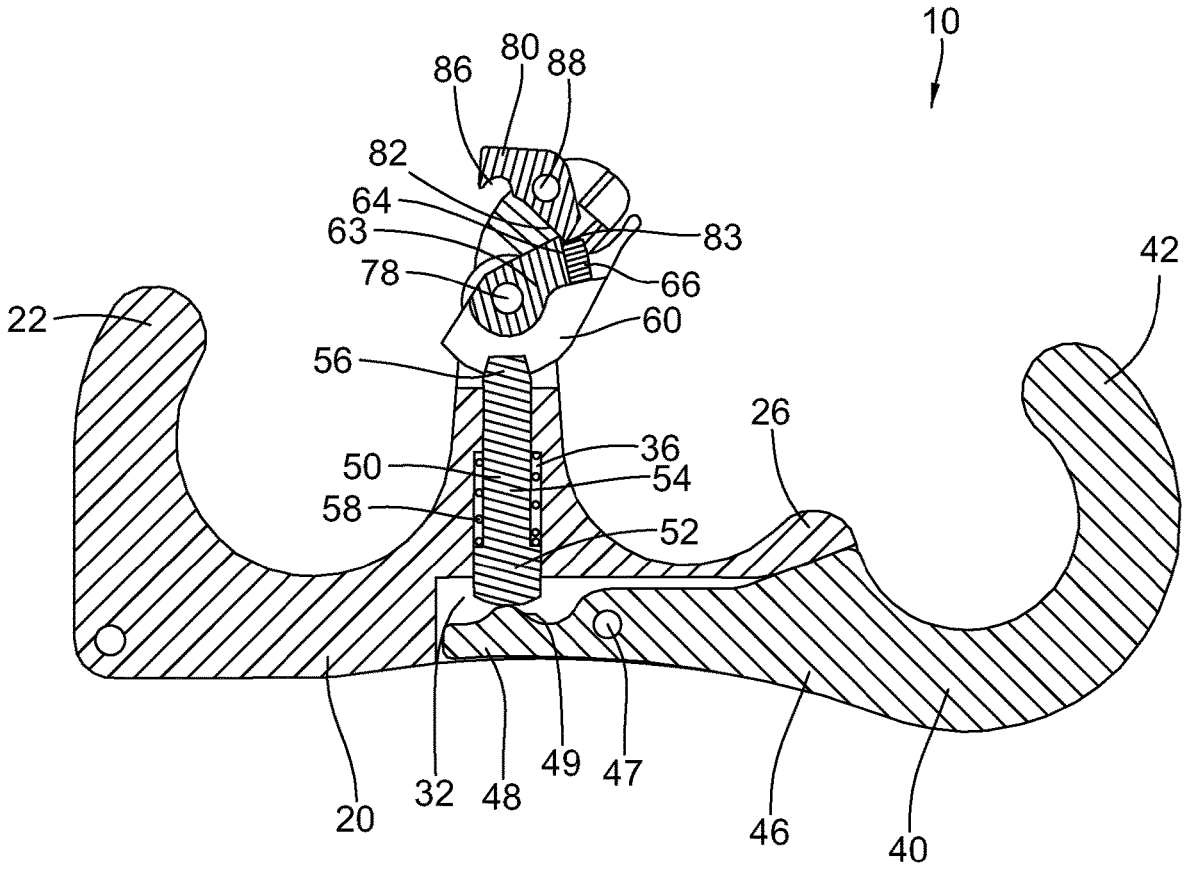
FIG. 4A is side cross-sectional view of the archery release aid of FIG. 1 in the locked position.
Figure 4B:
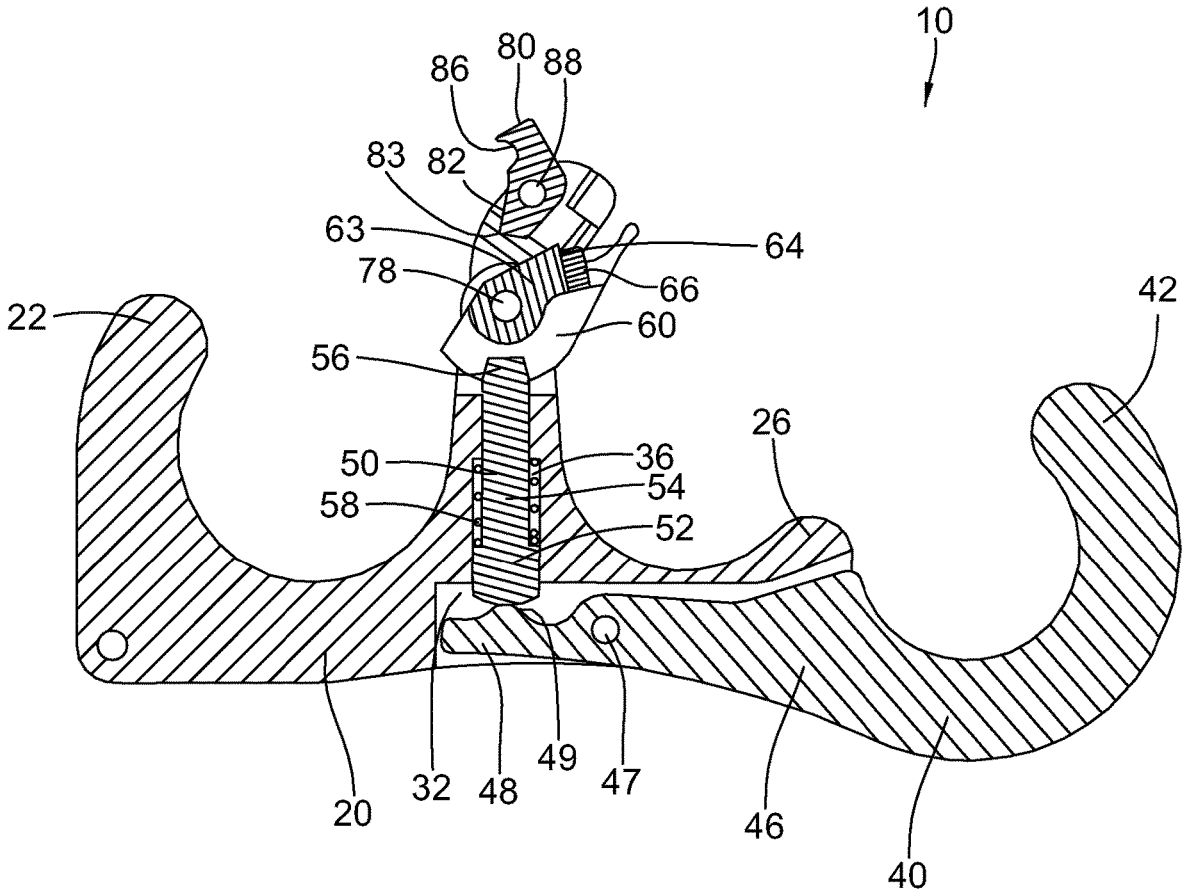
FIG. 4B is side cross-sectional view of the archery release aid of FIG. 1 in the released position.
Figure 5:
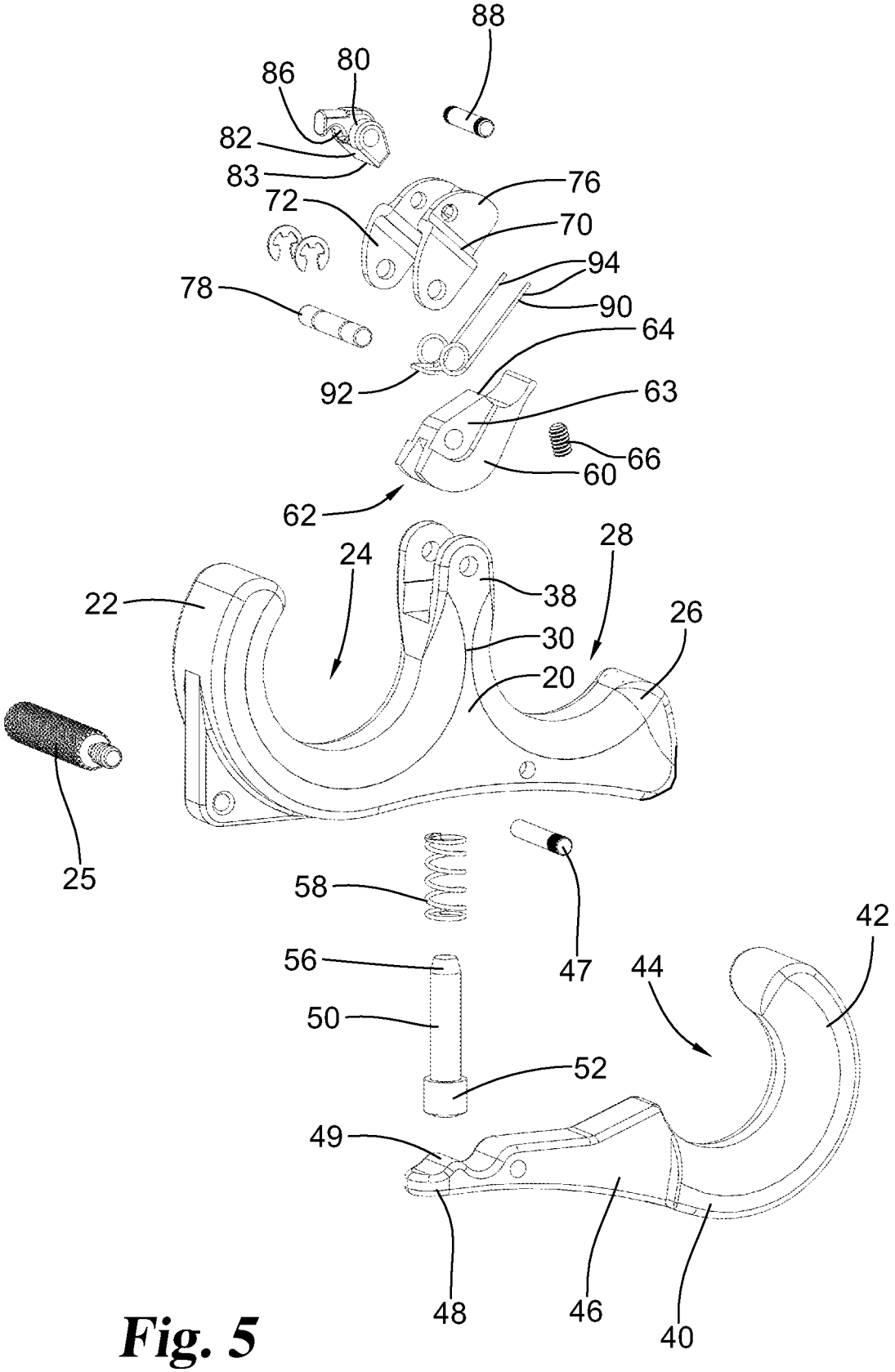
FIG. 5 is an exploded view of the archery release aid of FIG. 1.

FIG. 4A illustrates a side cross-sectional view of the archery release aid 10 in the locked position. FIG. 4B illustrates a side cross-sectional view of the archery release aid 10 in the released position. FIG. 5 illustrates the components in an exploded view.

As seen for instance in FIGS. 4A and 4B, handle 20 defines hollow central bore or passage 36 along the axis of post section 30. Handle 20 further defines a lever slot 32 extending along the rear side of release 10. Lever slot 32 has an inward end defined adjacent to and in communication with central bore 36. Lever slot 32 then extends outward defining a passageway exiting laterally from outward end 26 of handle 20. A length of release lever 40 is arranged within lever slot 32 and pivotally mounted to handle 20 via axle pin 47. Release lever 40 defines a lever arm portion 46 extending from axle pin 47 to outward end 42. Release lever 40 further defines an activating arm portion 48 extending inward from axle pin 47. The end of activating arm portion 48 is aligned with central bore 36. Optionally, activating arm portion 48 may include a protruding hump or rounded head portion 49 directed toward the axis of central bore 36.

Spring pin 50 is movably mounted within central bore 36. Spring pin 50 includes a shaft 54 arranged to selectively translate forward and rearward within central bore 36. Spring pin 50 includes a cap head portion 52 adjacent to and partially extending into lever slot 32. Cap head portion 52 is aligned with and may contact activating arm portion 48 and head portion 49. Rearward rotation of lever arm portion 46 correspondingly advances spring pin 50 to translate forward within central bore 36. Spring pin 50 further includes a distal end portion 56 which extends from and exits the forward end of central bore 36 between plate portions 38. In certain embodiments, distal end portion 56 includes a conically tapered end. Within handle 20, compressible coil spring 58 is mounted around shaft 54 between cap head portion 52 and an inner shelf or bearing surface of central bore 36. Coil spring 58 biases spring pin 50 in the rearward retracted direction.

The release head assembly includes sear body 60, bridge 70 and hook piece 80. Sear body 60 and bridge 70 are pivotally mounted to handle 20 between plate portions 38 using a shared axle pin 78. A lower portion of sear body 60 defines a channel 62 (seen in FIG. 3). Distal end portion 56 of spring pin 50 is oriented within channel 62. When spring pin 50 is retracted, sear body 60 may pivot relative to spring pin 50, yet distal end portion is maintained partially within or at least aligned with channel 62 as sear body 60 pivots. When spring pin 50 is advanced, the distal end portion 56 contacts the interior sides of channel 62 in a wedging action. This locks sear body 60 in place, preventing sear body 60 from pivoting relative to handle 20.

Sear body 60 further includes sear profile portion 63 defining a sear face 64. The sear profile portion 63 rotates in combination with the rotation of sear body 60. Sear face 64 defines a bearing surface and edge over which the sear face 82 and edge 83 of hook piece 80 overlap in the locked position. A set screw 66 can be advanced or retracted on sear body 60 to adjust the clearance amount by which the sear face 82 of hook piece 80 may overlap with sear face 64.

Bridge 70 has a lower portion 72 coaxially pivotally mounted to handle 20 with sear body 60 via shared axle pin 78. Hook piece 80 is pivotally mounted to an upper portion 76 of bridge 70 via an axle pin 88. When sear body 60 is locked in place, bridge 70 remains free to rotate, allowing hook piece 80 to translate radially relative to sear body 60.

Hook piece 80 includes an interior end defining sear face 82 and edge 83, arranged to overlap with sear face 64 of sear body 60 in the locked position. Hook piece 80 further includes an opposite and external end defining a groove 86 to receive the bowstring of a bow. In the illustrated embodiment, hook piece 80 is formed in an angled or bell-crank style shape.

Spring 90 is arranged between sear body 60 and bridge 70. Spring 90 includes a pair of mounting coils coaxially mounted along axle pin 78 with sear body 60 and bridge lower portion 72. A spring cross-piece 92 extends across and bears against a face of sear body 60 opposite to bridge 70. Spring 90 includes a pair of legs 94. Legs 94 extend from axle pin 78 and into a pair of passages defined in upper portion 76 of bridge 70. Alternately legs 94 could bear against a surface of upper portion 76. Spring 90 yieldingly biases bridge 70 and correspondingly hook portion 80 to the locked position shown in FIG. 4A relative to sear body 60. The biasing force of spring 90 helps minimize unintentional release for the hook piece and bowstring and separately biases bridge 70 and hook portion 80 to return to the locked position relative to sear body 60 after the bowstring is released.

Figure 6:
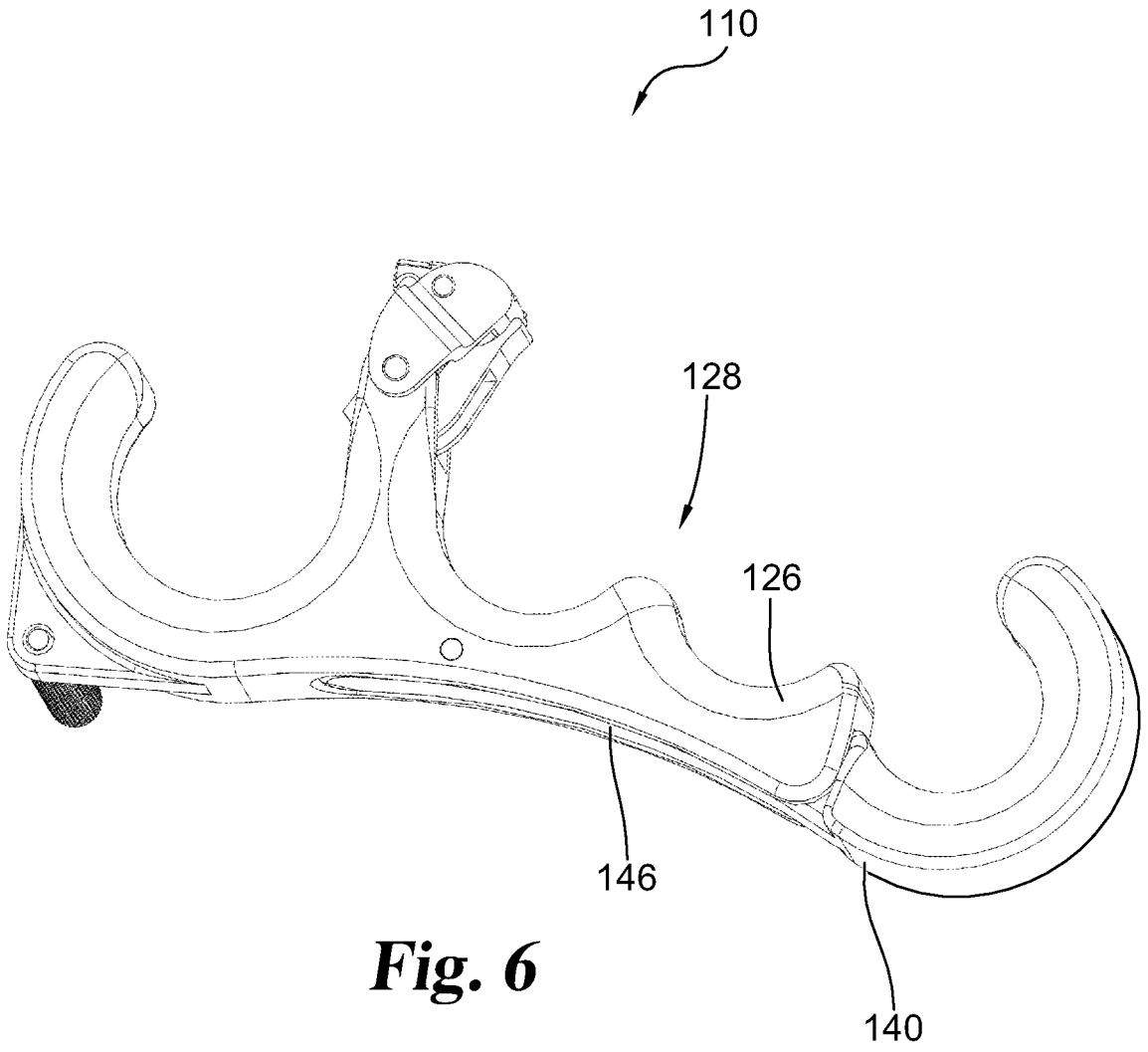
FIG. 6 is a perspective view of an alternate embodiment of an archery release aid illustrating an embodiment of the present disclosure.
Figure 7:
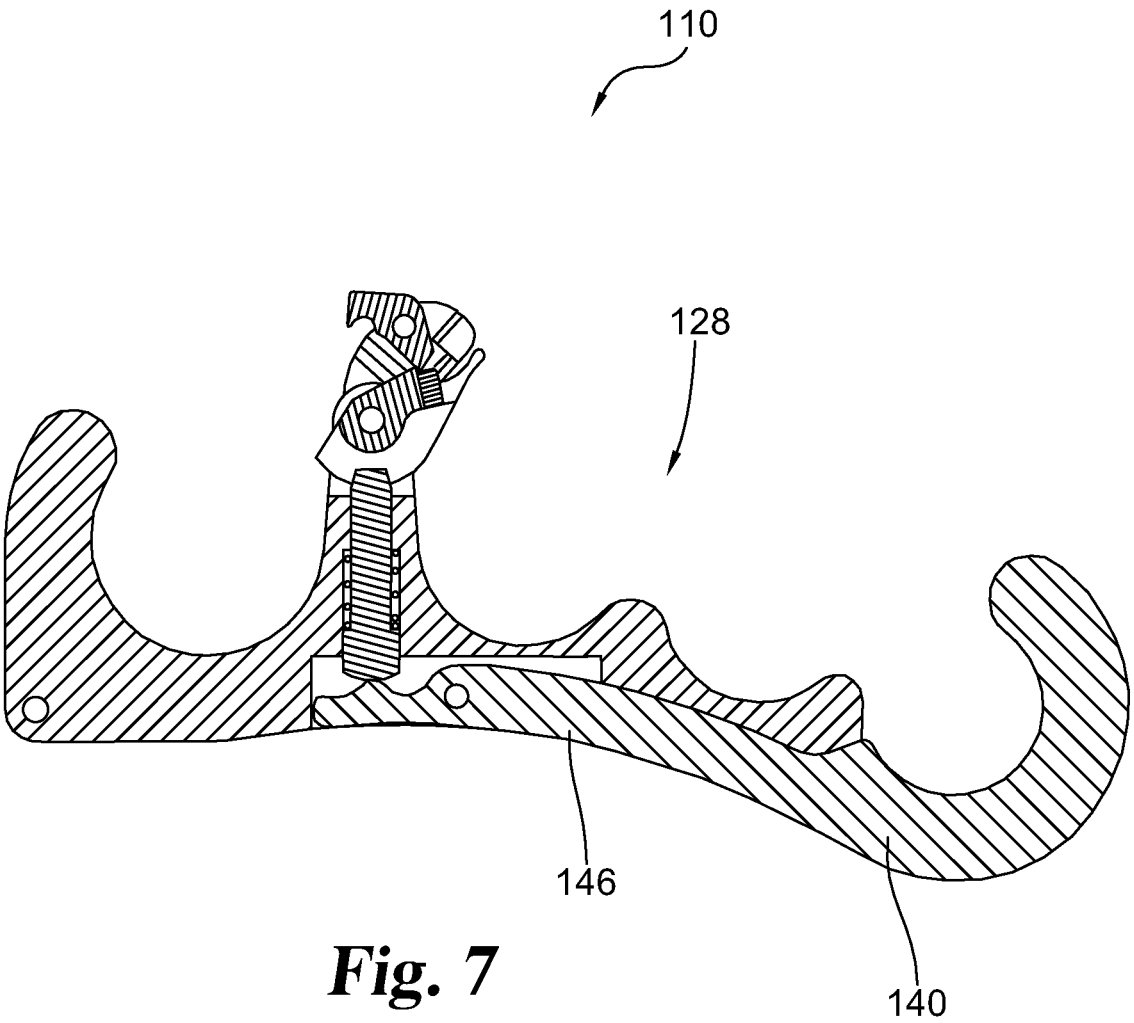
FIG. 7 is side cross-sectional view of the archery release aid of FIG. 6.

An alternate embodiment of a release aid 110 is illustrated in FIGS. 6 and 7. Release aid 110 is comparable in structure and operation to release aid 10. Release aid 110 differs from release aid 10 by incorporating a longer handle rear end 126 and openings/grooves 128 for both the archer's third and fourth fingers. The archer's pinky finger is received in the opening/groove of release lever 140. Alternately, an archer with larger hands could use release aid 110 with a third finger arranged in an openings/grooves 128 and the archer's fourth finger in the opening/groove of release lever 140. Corresponding to longer handle rear end 126, release lever 140 includes a longer lever arm portion 146.

Figure 8:
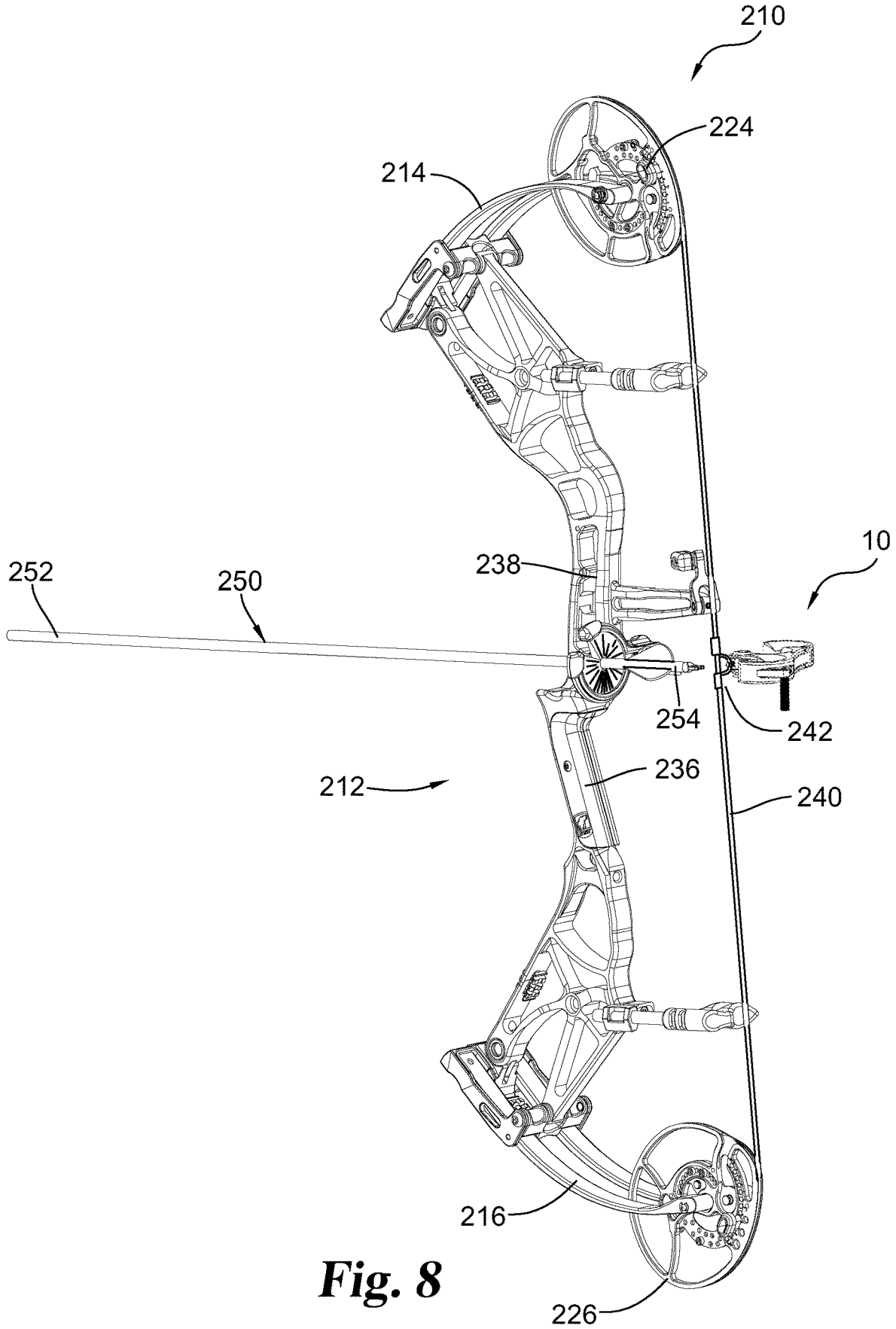
FIG. 8 is a perspective view illustrating an embodiment of an archery release aid according to the present disclosure in use with an archery bow and arrow.

FIG. 8 illustrates an embodiment of release aid 10 in combination with an archery bow 210 and arrow 250. A compound archery bow is illustrated as a representative example, but is not intended to be limiting. A typical compound archery bow 210 includes a riser 212. Riser 212 may include a handle portion 236 and an arrow rest mounting portion 238. A pair of limbs 214 and 216 extend from opposing ends of the riser. As illustrated each limb 214 and 216 is shown as a set of parallel limb pieces forming a quad-limb arrangement. In alternate embodiments, limbs 214 and 216 may each be formed as a single limb piece. A pair of rotational elements 224 and 226 such as pulleys or eccentric cams are pivotally mounted to the tips of limbs 214 and 216. Rotational elements 224 and 226 may be arranged in a one-cam, two-cam, hybrid cam or other compound bow arrangements as are known in the art. A bowstring 240 extends between rotational elements 224 and 226. Additional cabling is omitted for ease of illustrate. Optionally, a loop or "D" loop 242 is placed at a midpoint of bowstring 240. "D" loop 242 is typically aligned with an arrow rest.

Bow 210 is used with an arrow 250. Arrow 250 includes a shaft with a forward end 252, to which typically an arrowhead is mounted. A nock 254 is arranged at the rearward end of arrow 250. Nock 254 is configured to selectively engage bowstring 240, preferably between the ends of "D" loop 242.

In use, an archer loads an arrow 250 onto a bow, preferably with the nock 254 engaged between the ends of a "D" loop 242. The archer holds release aid 10 in the drawing hand and rotates hook piece 80 to ensure it is in the locked position shown in FIG. 4A (counter-clockwise rotation of hook piece 80 from the perspective of FIG. 4A). The archer then orients hook groove 86 to engage bowstring 240 and may begin drawing the release, and thus the bowstring and arrow, rearward to a full draw position. During the draw process the archer should not apply pressure to release lever 40.

At this stage, the entire release head assembly is freely pivotal relative to handle 20. The sear body 60, bridge 70 and hook piece 80 remain locked together so that they will not rotate relative to each other, yet they may rotate as a combined unit relative to handle 20. Correspondingly, release 10 will not release bowstring 240 despite any unintended or minor rotation of the release head assembly relative to the handle during the draw process.

After the archer has achieved full draw, the archer may use the outer fingers such as the third, fourth or pinky finger to pivot the outward end of safety release lever 40 in a lateral plane rearward relative the handle 20. This creates a lever moment where the activating arm portion 48 of the safety release lever 40 advances safety pin 50 forward within central bore 36. When safety pin 50 is advanced, the cone shaped distal end portion 56 advances into channel 62 of sear body 60. When distal end portion 56 engages channel 62 it forms a wedging action forming a brake effect. The brake effect prevents sear body 60 from rotating relative to handle 20. At this point, the safety in release aid 10 has been disengaged.

Next, the archer may pivot the release aid 10 slightly further in a lateral plane in the clockwise direction from the perspective of FIG. 4A. As the archer further pivots release 10, the bowstring tension causes bridge 70 to begin to rotate counter-clockwise around axle pin 78 relative to sear body 60, correspondingly radially translating hook piece 80 and axle pin 88 counter-clockwise relative to sear body 60. As hook piece 80 is translated, the overlap of hook sear face 82 over sear profile portion 63 is reduced until the edge 83 of hook sear face 82 passes the edge of sear face 64. Once the overlap is eliminated and the sear faces disengage, the force of bowstring 240 causes hook piece 80 to rotate to the unlocked position shown in FIG. 4B, thereby releasing bowstring 240 and correspondingly releasing arrow 250—a firing event. The Hook piece rotates clockwise from the perspective of FIG. 4B. This arrangement forces the archer to completely and smoothly pull through the shot, helping to overcome target panic.

Figure 9:
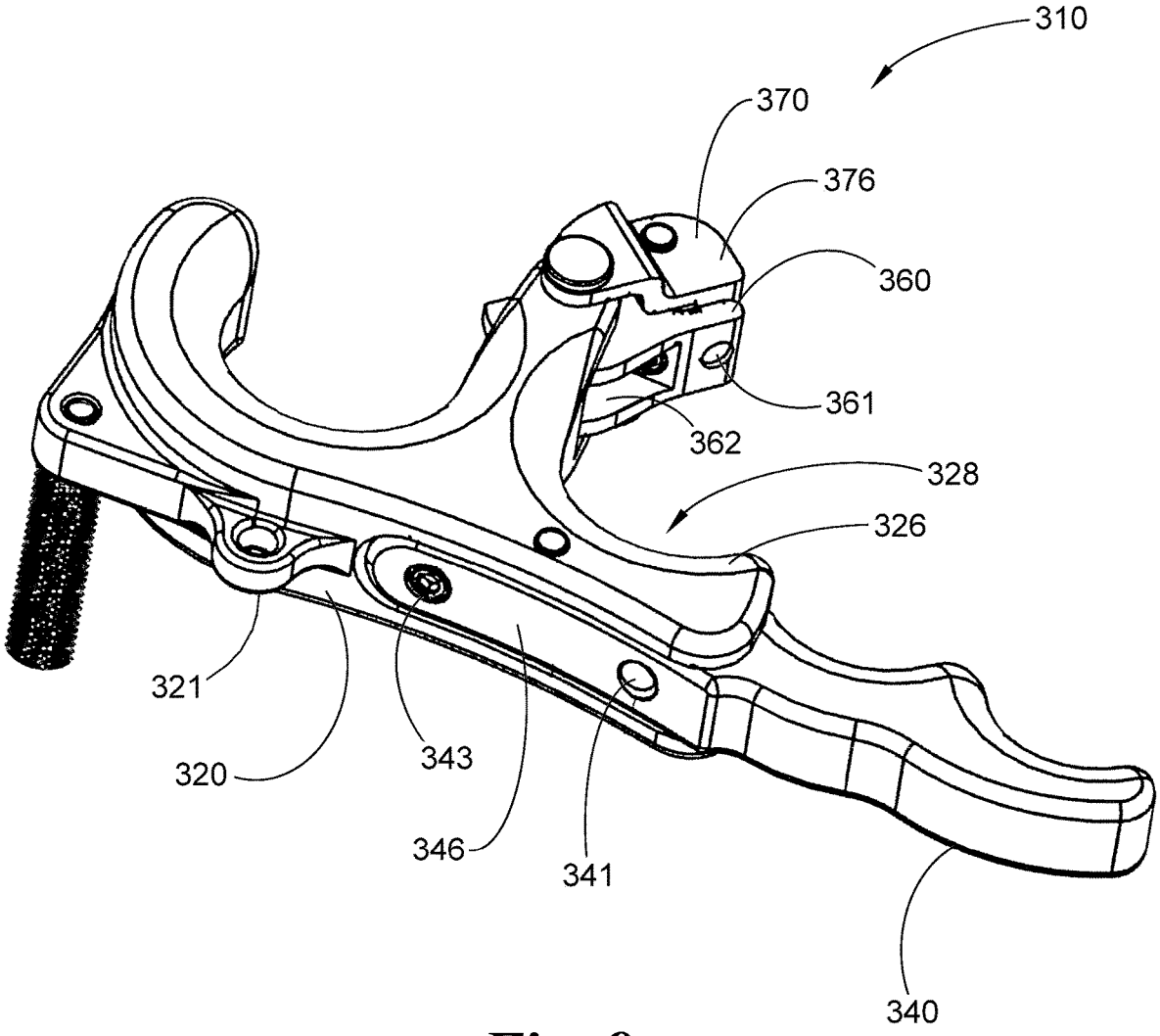
FIG. 9 is a perspective view of an alternate embodiment of an archery release aid illustrating an embodiment of the present disclosure.
Figure 10:
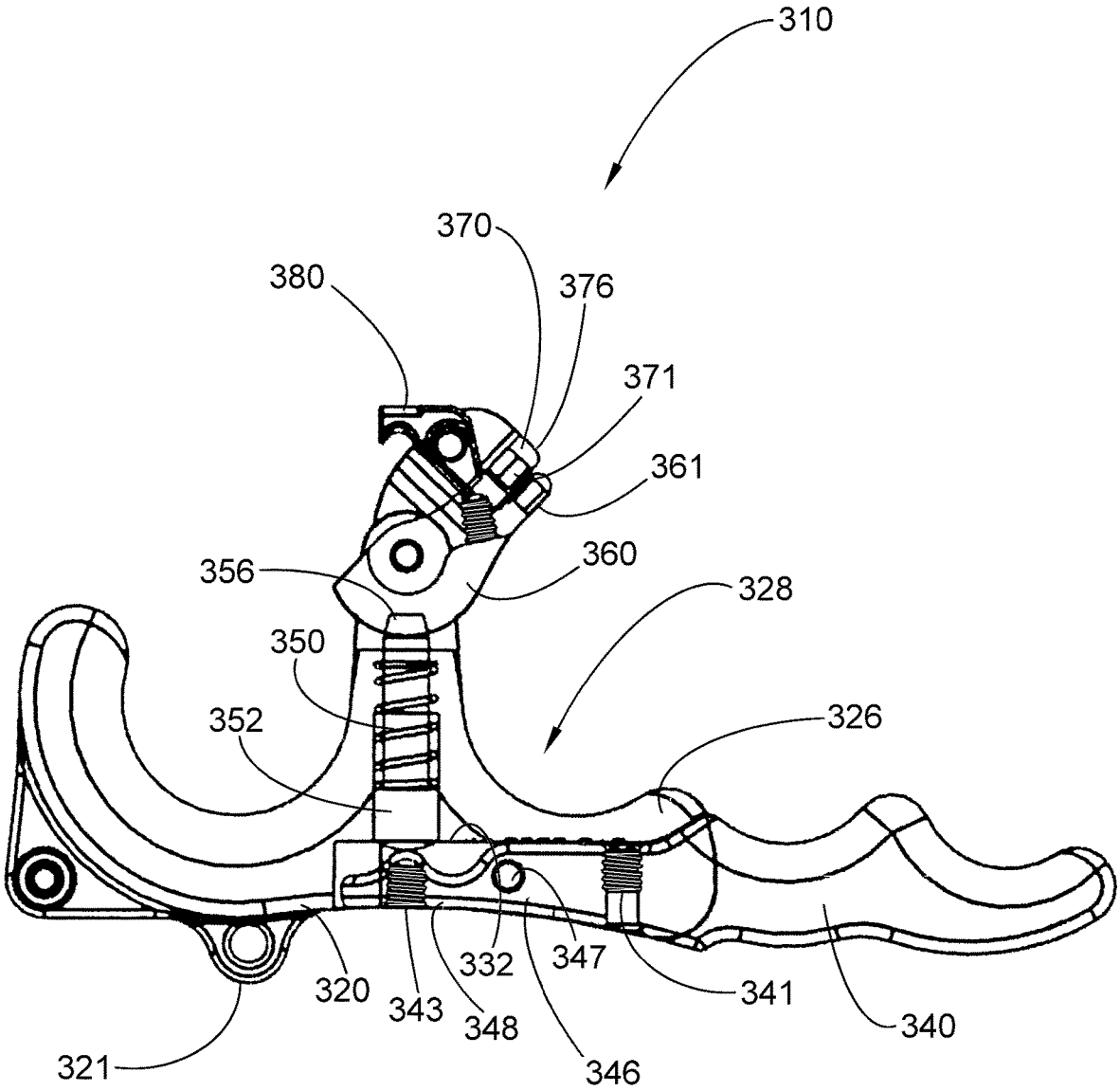
FIG. 10 is a cross-sectional view of the archery release aid of FIG. 9.
Figure 11:
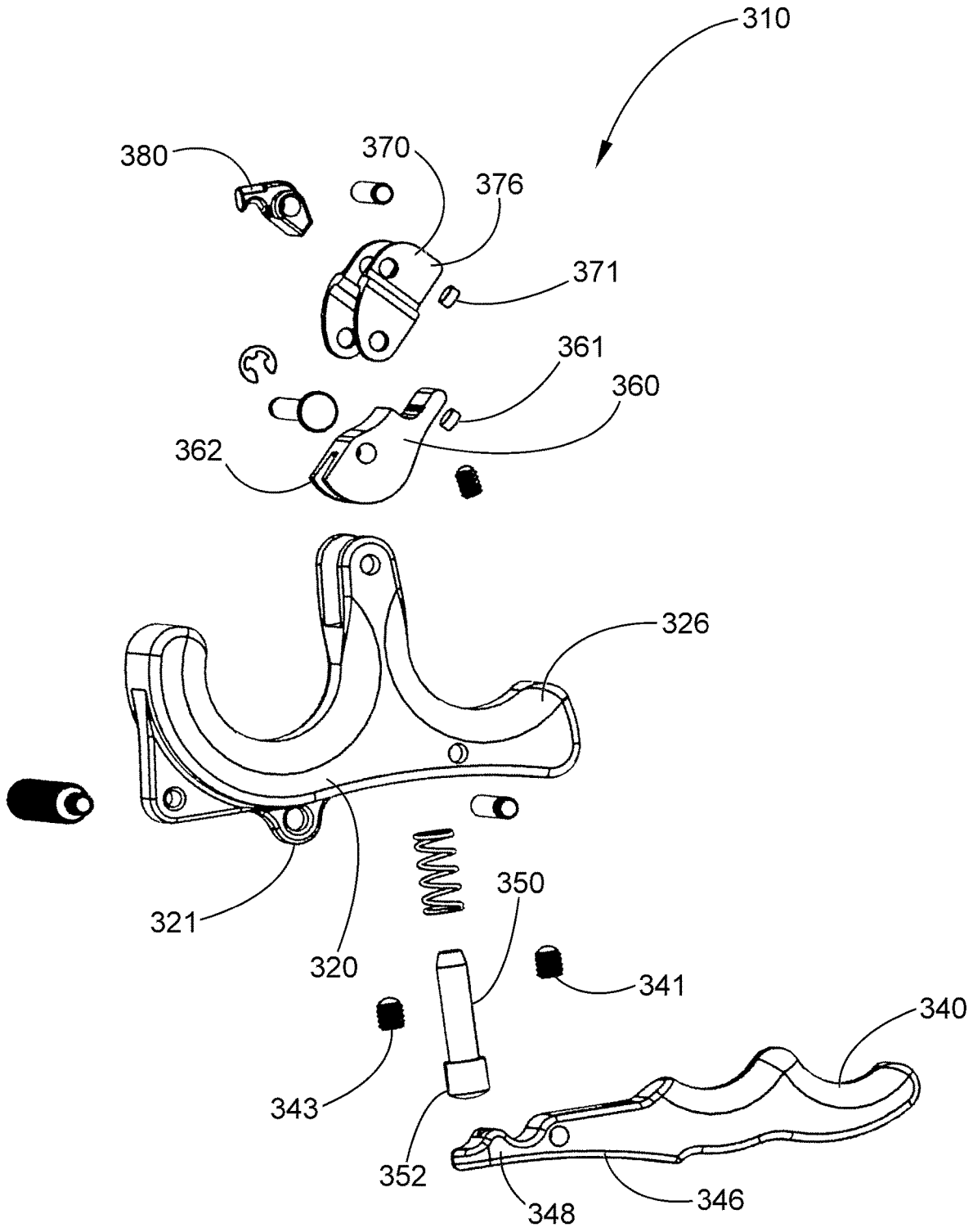
FIG. 11 is an exploded view of the archery release aid of FIG. 9.

An alternate embodiment of a release aid 310 is shown in FIGS. 9-11. Release aid 310 is comparable in structure and operation to release aid 10. Release aid 310 primarily differs from release aid 10 by changing the biasing force holding together a sear body 360 and a bridge 370. For example, the biasing force is changed from a spring force to a magnetic force. As was mentioned previously, the biasing spring force, in one example, is supplied by spring 90. In other examples, the biasing magnetic force is supplied by a pair of magnets, such as magnet 361 and magnet 371.

As best depicted in FIGS. 10 and 11, the release aid 310 includes a magnetic holding and reset mechanism. The magnetic mechanism includes a pair of magnets with polarity arranged to attract each other. For example, the negative pole of one magnet faces the positive pole of the other magnet. In one example the pair of magnets includes the first magnet 361 and the second magnet 371. The first magnet 361 is housed within a sear body 360. The second magnet 371 is housed within an upper portion 376 of a bridge 370. The magnetic attraction force of the magnets 361 and 371 minimizes the risk of an unintentional release by holding the sear body 360 and bridge 370 together. However, the magnetic attraction force between the sear body 360 and bridge 370 can be overcome during the release process. Additionally, the magnetic force biases the bridge 370 and hook piece 380 to return and abut the sear body 360 after the bowstring is released.

Release aid 310 includes a release lever 340 with a modified lever arm portion 346. Optionally, the modified lever arm portion 346 may include one or more set screws 341 and 343. The first set screw 341 may be positioned in the lever arm portion 346 outward from the pivot point of lever arm portion 346. The first set screw 341 adjustably protrudes from lever arm portion toward handle rear end 326. The second set screw 343 may be positioned in the activating arm portion 348 inward from the pivot point of the lever arm portion 346. The second set screw 343 is aligned with spring pin 350 and adjustably protrudes from activating arm portion 348 toward spring pin cap head portion 352. The one or more set screws 341 and 343 enable an archer to adjust or tune the release based on personal preference.

As best shown in FIG. 10, adjusting the first set screw 341 forward (towards lever slot 332) adjusts the spacing distance between the lever arm portion 346 and handle rear end 326 in an untriggered condition. Specifically, advancing first set screw 341 increases the minimum distance between the lever arm portion 346 and handle rear end 326, which correspondingly decreases the distance between the activating arm portion 348 and spring pin 350. Retracting first set screw 341 decreases the distance between the lever arm portion 346 and handle rear end 326 in an untriggered condition. Decreasing or increasing the distance between the activating arm portion 348 and handle rear end 326 adjusts the amount of rotation of the lever arm required to release an arrow. When both set screws are advanced a sufficient different, the release can be adjusted to hold spring pin 350 in the forward position without the archer needing to rotate release lever. The release is then operable without the safety feature of the release lever.

Separately, optional second set screw 343 protrudes from activating arm portion 348. The protrusion distance of second set screw 343 can be advanced to adjust the distance between the activating arm portion 348 and the cap head portion 352 in an untriggered condition. As should be appreciated, the smaller the distance between the activating arm portion 348 and the cap head portion 352 the less rotation of the lever arm is needed to trigger the release.

Handle 320 may include an optional accessory loop 321. The accessory loop 321 enables an archer to connect a lanyard or string to release aid 310 to prevent dropping and/or losing the release aid. As should be appreciated, any of the release aids herein, including release aids 10 and 110, may optionally include an accessory loop.

Figure 12:
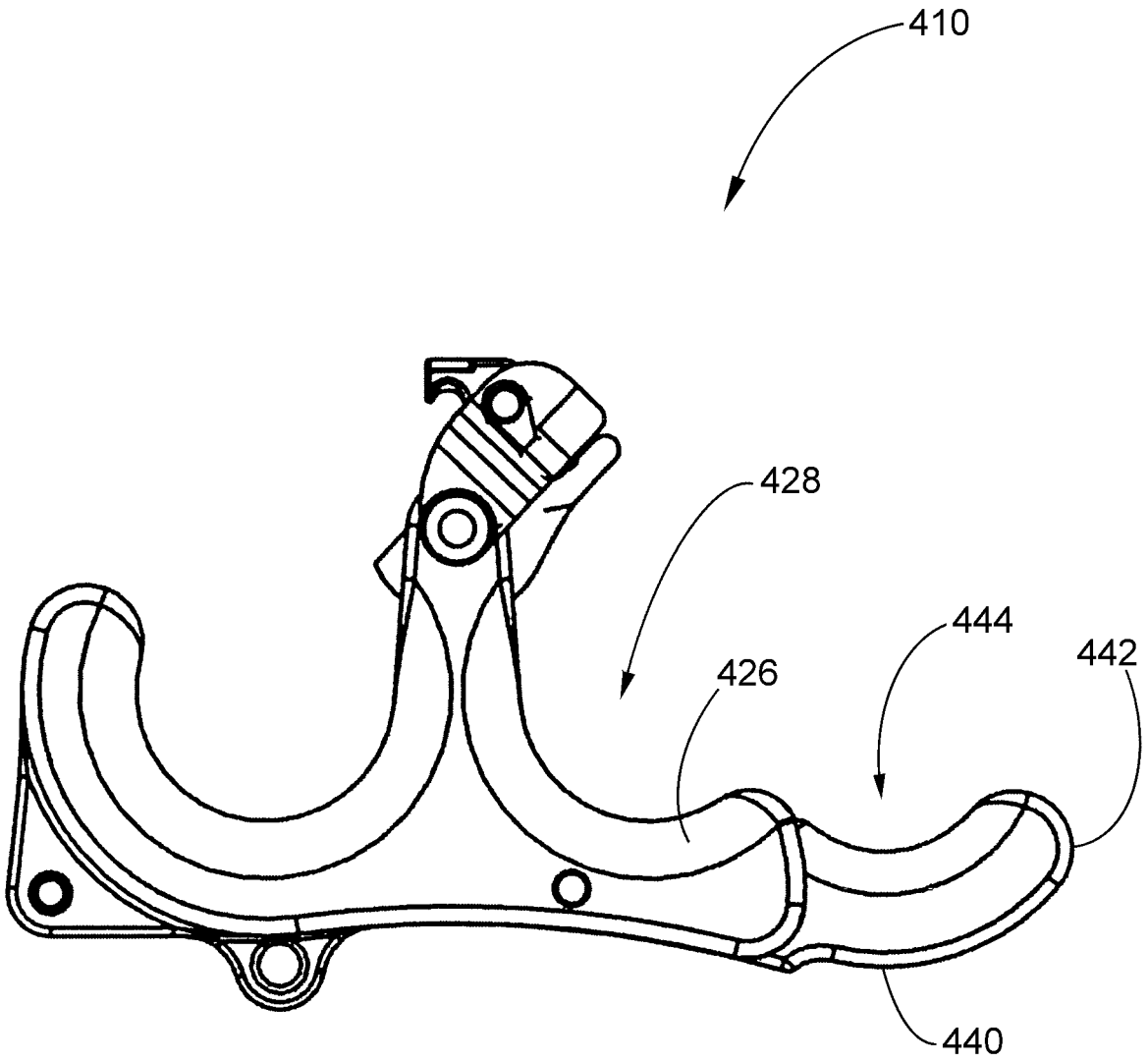
FIG. 12 is a side view of an alternate embodiment of an archery release aid illustrating an embodiment of the present disclosure.
Figure 13:
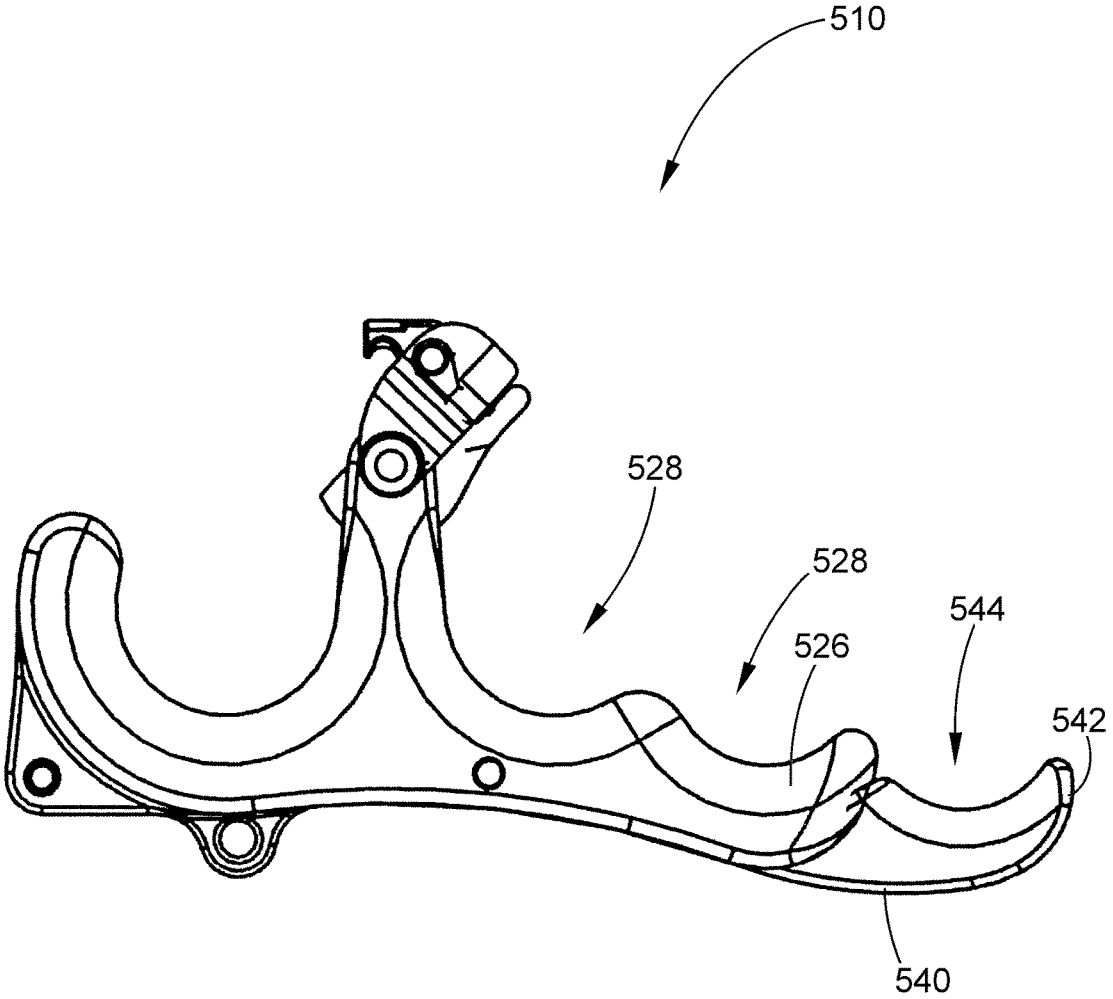
FIG. 13 is a side view of an alternate embodiment of an archery release aid illustrating an embodiment of the present disclosure.
Figure 14:
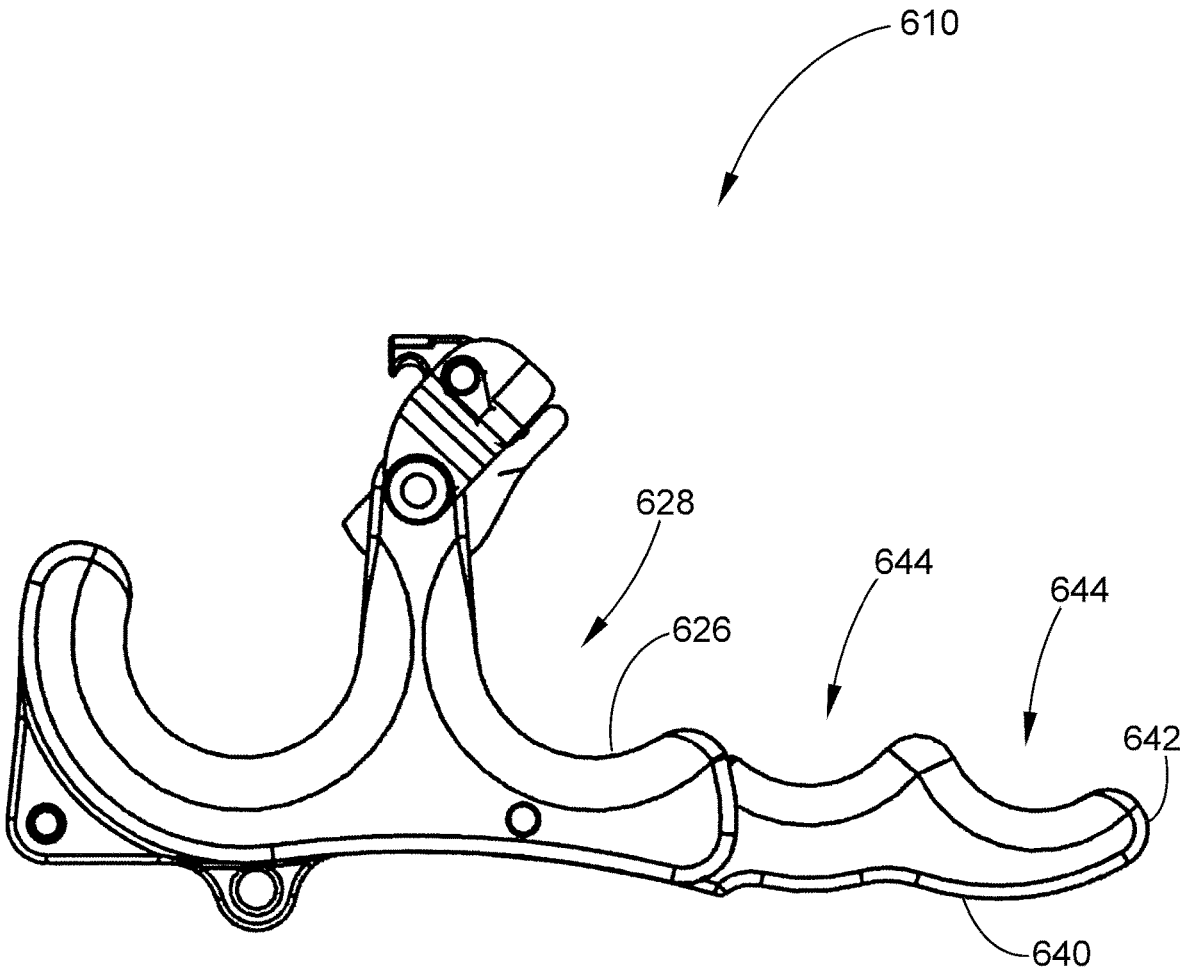
FIG. 14 is a side view of an alternate embodiment of an archery release aid illustrating an embodiment of the present disclosure.

FIGS. 12-14 illustrate various alternate embodiments of a release aids 410, 510, and 610 utilizing a straight back release lever design. Release aids 410, 510, and 610 are comparable in structure and operation to release aids 10 and 310. Release aid 410 differs from release aids 10 and 310 by reducing the curvature of an outward end 442 of a release lever 440. The reduction in curvature straightens the release lever 440 and reduces the depth of an opening/groove 444. The depth reduction of the opening/groove 444 allows an archer with larger hands a more comfortable position for the archer's third and fourth fingers.

Release aid 510 differs from release aids 10 and 310 by incorporating a longer handle rear end 526 and openings/grooves 528 for both the archer's third and fourth fingers. The archer's pinky finger is received in the opening/groove of release lever 540. Alternately, an archer with larger hands could use release aid 510 with a third finger arranged in an openings/grooves 528 and the archer's fourth finger in the opening/groove of release lever 540. Corresponding to longer handle rear end 526, release lever 540 includes a longer lever arm portion.

Release aid 610 differs from release aids 10 and 310 by incorporating a longer release lever 640 and openings/grooves 644 for both the archer's fourth and pinky fingers. The archer's third finger is received in the opening/groove 628 of handle outer end 626. Alternately, an archer with larger hands could use release aid 610 with their third and fourth fingers arranged in openings/grooves 644. Longer release lever 640 creates a mechanical advantage as an archer is able to provide a greater amount of force when using the fourth and pinky fingers.

Figure 15:
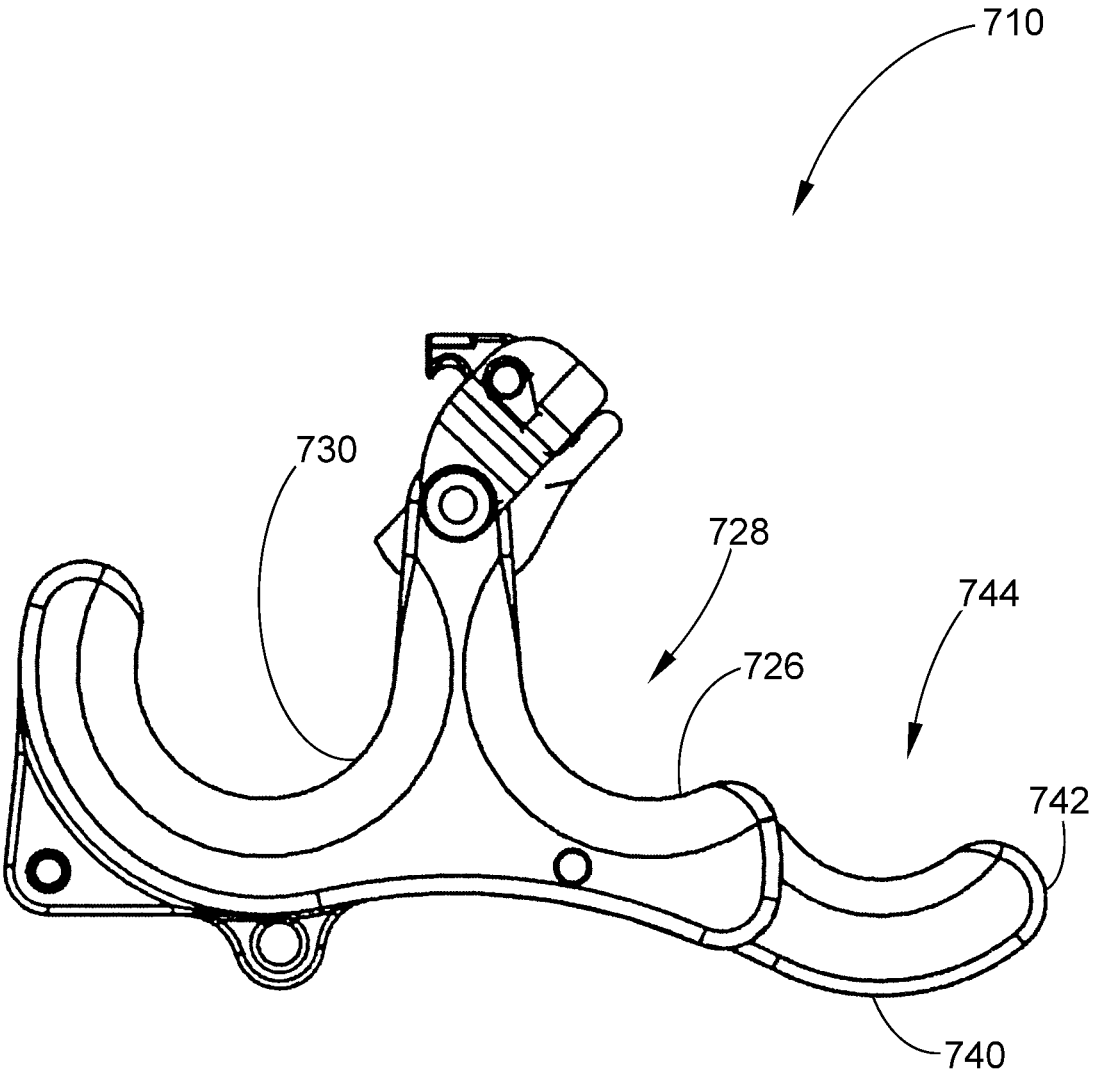
FIG. 15 is a side view of an alternate embodiment of an archery release aid illustrating an embodiment of the present disclosure.
Figure 16:
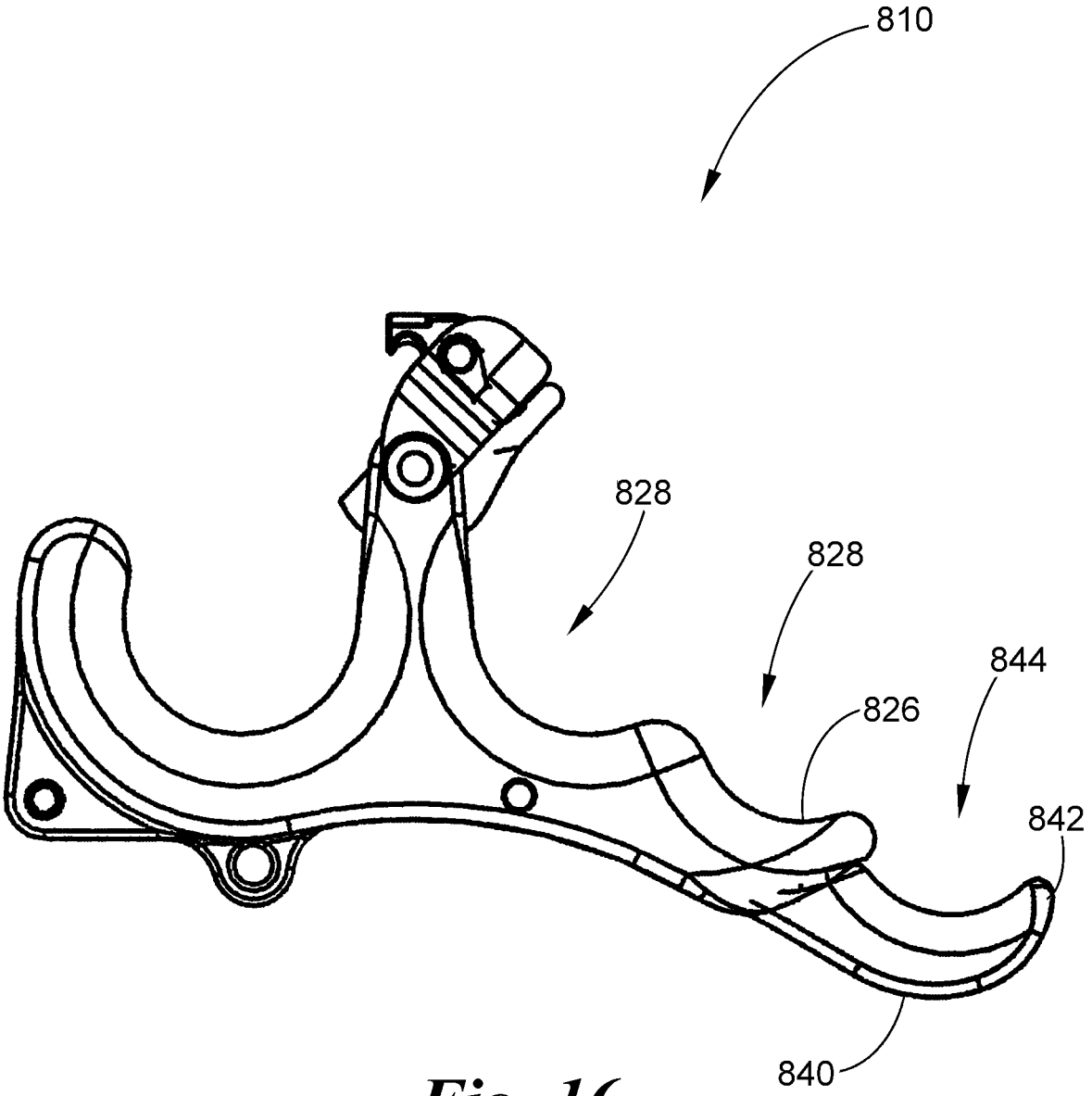
FIG. 16 is a side view of an alternate embodiment of an archery release aid illustrating an embodiment of the present disclosure.
Figure 17:
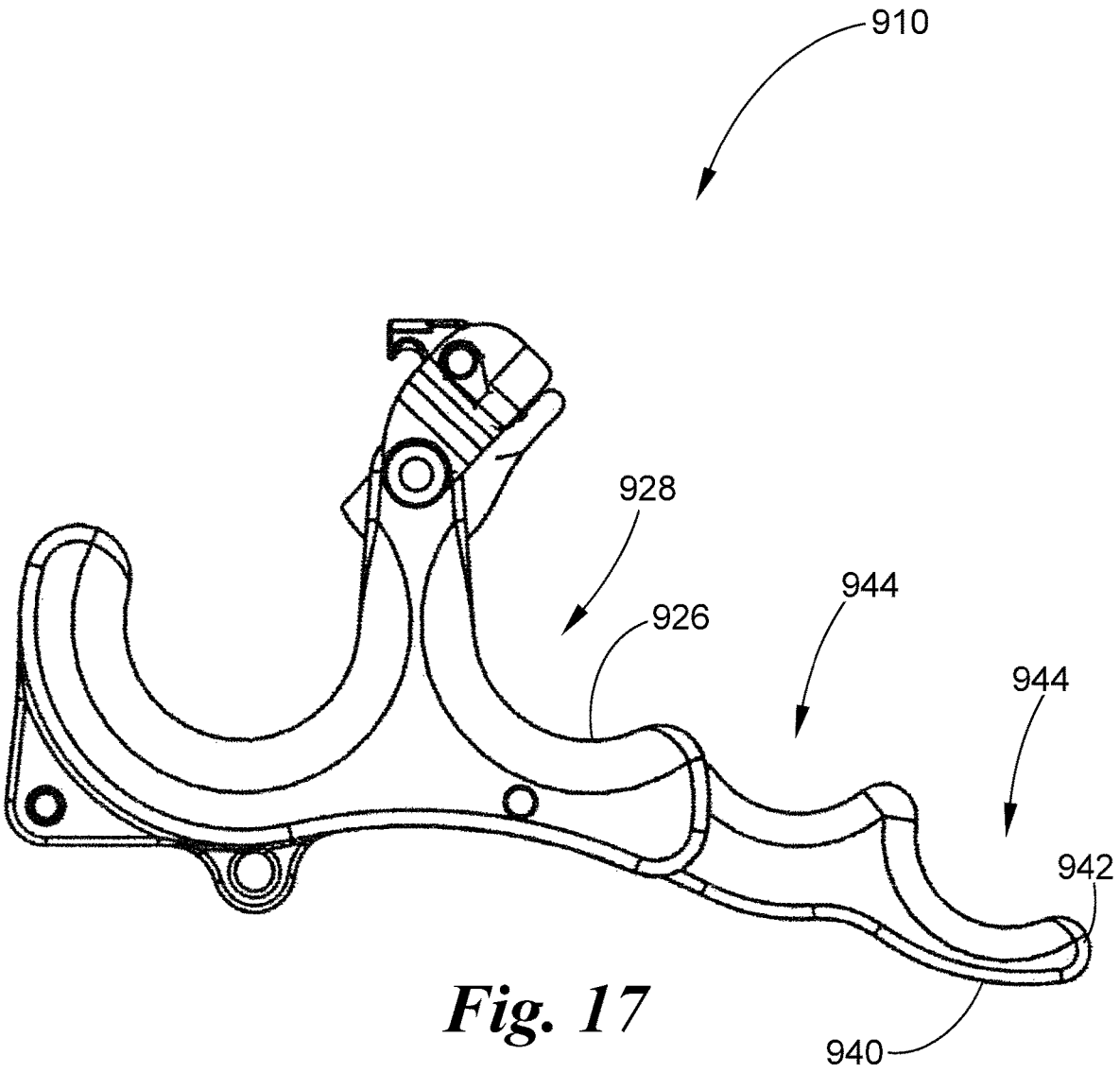
FIG. 17 is a side view of an alternate embodiment of an archery release aid illustrating an embodiment of the present disclosure.

FIGS. 15-17 illustrate various alternate embodiments of a release aids 710, 810, and 910 utilizing a swept back release lever design. Release aids 710, 810, and 910 are comparable in structure and operation to release aids 10 and 310. Release aid 710 differs from release aid 10 by reducing the curvature of an outward end 742 of a release lever 740. The reduction in curvature straightens the release lever 740 and reduces the depth of an opening/groove 744. The depth reduction of the opening/groove 744 allows an archer with larger hands a more comfortable position for the archer's third and fourth fingers. Furthermore, release aid 710 differs from release aid 410 by situating the release lever 740 at a swept back position with respect to a post section 730.

Release aid 810 differs from release aids 10 and 310 by incorporating a longer handle rear end 826 and openings/grooves 828 for both the archer's third and fourth fingers. The archer's pinky finger is received in the opening/groove of release lever 840. Alternately, an archer with larger hands could use release aid 810 with a third finger arranged in an openings/grooves 828 and the archer's fourth finger in the opening/groove of release lever 840. Corresponding to longer handle rear end 826, release lever 840 includes a longer lever arm portion.

Release aid 910 differs from release aids 10 and 310 by incorporating a longer release lever 940 and openings/grooves 944 for both the archer's fourth and pinky fingers. The archer's third finger is received in an opening/groove 928 of handle outer end 926. Alternately, an archer with larger hands could use release aid 910 with their third and fourth fingers arranged in openings/grooves 944. Longer release lever 940 creates a mechanical advantage as an archer is able to provide a greater amount of force when using the fourth and pinky fingers.

Figure 18:
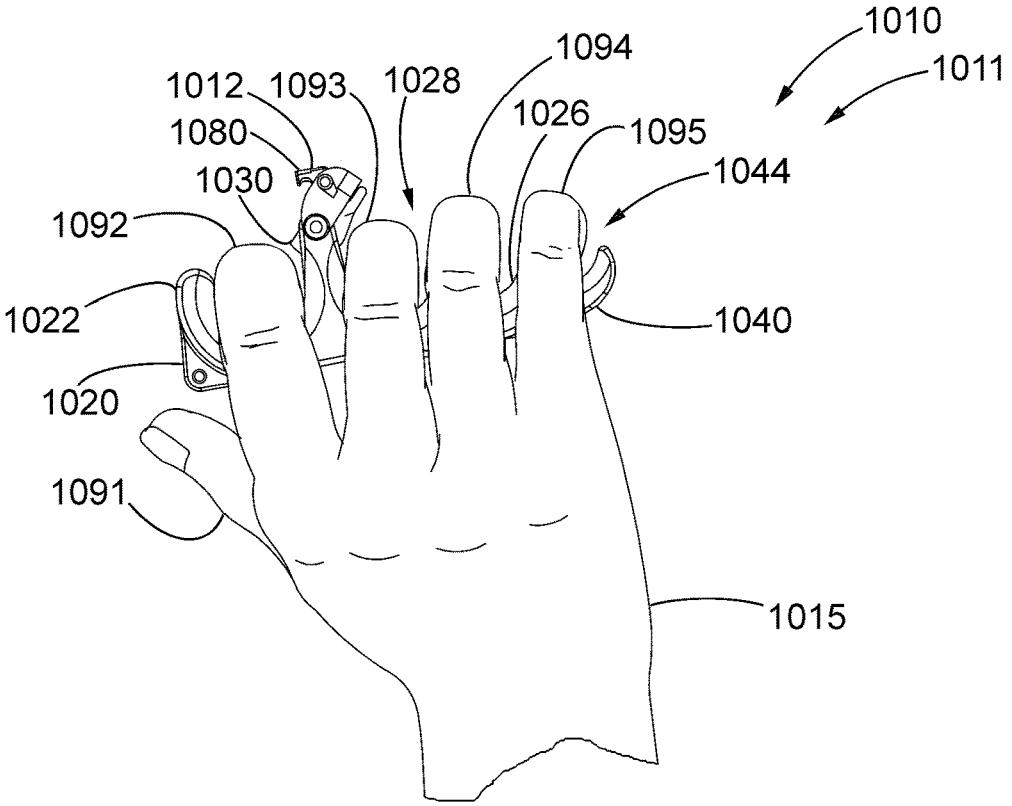
FIG. 18 is a side view of an archer's hand holding a release aid in a first position.

In the example shown in FIG. 18, an archer's hand 1015 holds a release aid 1010 in a first position 1011. Generally, the archer's hand 1015 includes inner and outer fingers. For example, the archer's hand 1015 may include inner fingers such as a thumb 1091, and/or an index finger 1092 and outer fingers such as a third finger 1093, a fourth finger 1094, and/or a pinky finger 1095.

In the example embodiment, the release aid 1010 incudes a handle 1020 with an inward end 1022. The inward end 1022 may include one or more grooves to receive the index finger 1092 of an archer. The handle 1020 further includes an outer end 1026. The outer end 1026 is separated from the inward end 1022 by a post section 1030 arranged intermediate the inward end 1022 and the outer end 1026. The outer end 1026 generally includes one or more grooves 1028 to receive the third finger 1093, the fourth finger 1094, and/or the pinky finger 1095 of an archer. Extending outward from the outer end 1026 is a release lever 1040. The release lever 1040 generally includes one or more grooves 1044 to receive one or more outer fingers, most commonly the fourth finger 1094 and/or the pinky finger 1095 of an archer.

In the first position 1011 (best shown in FIG. 18), a hook piece 1080 is in a latched position 1012. In the latched position 1012, the hook piece 1080 will not release the bowstring despite some rotation of the release aid 1010 as the release head assembly is freely pivotal relative to the handle 1020. Correspondingly, the third finger 1093, the fourth finger 1094, and/or the pinky finger 1095 of the archer do not apply rotational force to the release lever 1040 in the first position 1011.

Figure 19:
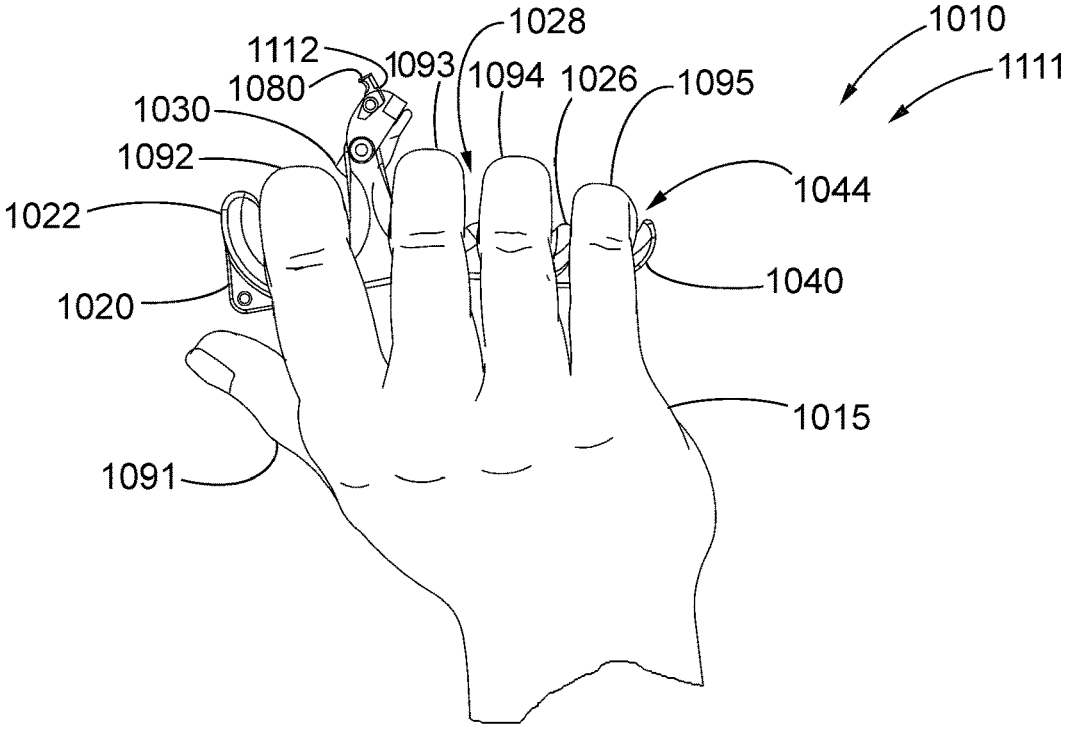
FIG. 19 is a side view of the archer's hand holding the release aid of FIG. 18 in a second position.

FIG. 19 illustrates the release in a second position 1111. Starting from the first position, the outer fingers such as the fourth finger 1094, and/or the pinky finger 1095 apply force (clockwise with respect to FIG. 19) to rotate the release lever 1040 to the second position 1111. Then, the archer rotates the handle further, which rotates the handle relative to portions of the release head assembly, allowing the hook piece 1080 rotate to a released position 1112. In the released position 1112, the hook piece 1080 releases the bowstring and fires an arrow.

As should be appreciated, an archer may apply rotational force to the release lever 1040 with any of the archer's outer fingers, although most typically the archer's third finger 1093 will remain on the handle. In another example, an archer with smaller hands may apply rotational force with the pinky finger 1095. In other examples, the archer may choose to apply rotational force with more than one finger, such as the third 1093 and fourth fingers 1094 or the fourth 1094 and pinky fingers 1095.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A release aid for drawing a bowstring of an archery bow, comprising:

a handle having an inward end with one or more grooves to receive one or more fingers, an outward end with one or more grooves to receive one or more fingers, and a post section extending forward from the handle and arranged intermediate the inward end and the outward end, wherein the post section defines a central bore;

a spring pin arranged to travel forward and rearward within the central bore;

a release lever pivotally connected to and extending from the outward end of the handle, wherein the release lever has an outward end with one or more grooves to receive one or more fingers, and wherein the release lever includes an inwardly protruding lever arm portion rotatable to advance the spring pin forward within the central bore; and a release head assembly having a sear body, a bridge pivotally connected to the sear body wherein the bridge includes an upper portion, and a hook piece pivotally connected to the bridge for selectively retaining an archery bow bowstring while the bow is drawn, wherein the release head is pivotally connected to the post section, wherein rotation of the release lever causes forward advancement of the spring pin to engage and prevent rotation of a portion of the release head assembly; and a pair of magnets with a first magnet housed within the sear body and a second magnet housed within the upper portion of the bridge;

wherein the first magnet and the second magnet are arranged to generate an attraction force, and wherein the attraction force yieldingly holds the sear body against the bridge.

2. The release aid of claim 1, wherein the attraction force is overcome by rotation of the release lever during a firing event, wherein the firing event separates the sear body and the bridge, and wherein the attraction force returns the sear body to abut the bridge after the firing event to form an automatic reset.

3. The release aid of claim 1, wherein the outward end of the release lever has two or more grooves to receive one or more of an archer's outer fingers.

4. The release aid of claim 1, wherein the lever arm portion of the release lever includes a first set screw arranged within the lever arm portion outward from a pivot point formed by an axle pin, and a second set screw arranged within the lever arm portion inward from the pivot point formed by the axle pin.

5. The release aid of claim 4, wherein the first set screw is adjustable forward and rearward within the lever arm portion, wherein forward adjustment of the first set screw increases a spacing distance between the lever arm portion and a handle rear end, and wherein rearward adjustment of the first set screw decreases a spacing distance between the lever arm portion and the handle rear end.

6. The release aid of claim 4, wherein the second set screw is adjustable forward and rearward within the lever arm portion, wherein forward adjustment of the second set screw decreases a spacing distance between the lever arm portion and the spring pin, and wherein rearward adjustment of the second set screw increases a spacing distance between the lever arm portion and the spring pin.

7. The release aid of claim 4, wherein the lever arm portion includes an activating arm portion protruding inward from the pivot point formed by the axle pin, wherein the activating arm portion is aligned with the spring pin, and wherein the second set screw is arranged in the activating arm portion.

8. The release aid of claim 1, wherein the spring pin includes a distal end portion extending from a forward end of the central bore and into a channel of a sear body, and wherein the distal end portion has a conically tapered end which is movable forward to wedge into the channel to prevent rotation of the sear body relative to the handle.

9. A release aid for drawing a bowstring of an archery bow, comprising:

a handle having an inward end, an outward end, and a post section extending forward from the handle and arranged intermediate the inward end and the outward end, wherein the post section defines a central bore;

a release lever pivotally connected to the handle, the release lever having an outward end with one or more grooves for one or more of the archer's outward fingers, wherein the outward end extends from the outward end of the handle, the release lever having a lever arm portion extending outward from a pivot point and an activating arm portion extending inward from the pivot point;

a spring pin arranged to move forward and rearward within the central bore, the spring pin having a cap head portion extending rearward in the central bore, and a distal end portion extending forward;

a release head assembly having a bridge pivotally mounted to the post section, a sear body pivotally mounted to the post section, and a hook piece pivotally mounted to the bridge, wherein the sear body defines a channel;

wherein the release lever is pivotable between a first position and a second position, wherein in the first position the spring pin is in a rearward position in the post section and the sear body is free to rotate relative to the post section;

wherein in the second position the release lever pushes the spring pin forward in the post section so that the distal end portion protrudes from the central bore and wedges within the sear body channel preventing the sear body from rotating relative to the post section; and wherein the lever arm portion of the release lever includes a first set screw arranged within the lever arm portion outward from the pivot point formed by an axle pin, and a second set screw arranged within the activating arm portion inward from the pivot point formed by the axle pin.

10. The release aid of claim 9, wherein the outward end of the release lever has two or more grooves to receive one or more or an archer's outer fingers.

11. The release aid of claim 9, wherein the first set screw is adjustable forward and rearward within the lever arm portion, wherein adjusting the first set screw forward increases a spacing distance between the lever arm portion and a handle rear end, and wherein adjusting the first set screw rearward decreases a spacing distance between the lever arm portion and the handle rear end.

12. The release aid of claim 9, wherein the second set screw is adjustable forward and rearward within the activating arm portion, wherein adjusting the second set screw forward decreases a spacing distance between the activating arm portion and the spring pin, and wherein adjusting the second set screw rearward increases a spacing distance between the activating arm portion and the spring pin.

13. A release aid for drawing a bowstring of an archery bow, comprising:

a handle having an inward end, an outward end, and a post section extending forward from the handle and arranged intermediate the inward end and the outward end, wherein the post section defines a central bore;

a release head assembly having a bridge pivotally mounted to the post section, a sear body pivotally mounted to the post section, and a hook piece pivotally mounted to the bridge, wherein the hook piece includes a hook groove to receive a bowstring;

a spring pin arranged to move forward and rearward within the central bore;

a release lever pivotally connected to the handle and rotatable to advance the spring pin forward to engage the release assembly; and, a first magnet housed within the sear body and a second magnet housed within the bridge, wherein the first magnet and the second magnet are arranged to generate an attraction force, and wherein the attraction force yieldingly holds the sear body and the bridge together.

14. The release aid of claim 13, wherein the outward end of the release lever has two or more grooves to receive one or more fingers.

15. The release aid of claim 13, wherein a lever arm portion of the release lever includes a first set screw arranged within the lever arm portion outward from a pivot point formed by an axle pin, a second set screw arranged within the lever arm portion inward from the pivot point formed by the axle pin.

16. The release aid of claim 15, wherein the first set screw is adjustable forward and rearward within the lever arm portion, wherein adjusting the first set screw forward increases a spacing distance between the lever arm portion and a handle rear end, and wherein adjusting the first set screw rearward decreases a spacing distance between the lever arm portion and the handle rear end.

17. The release aid of claim 15, wherein the second set screw is adjustable forward and rearward within the lever arm portion, wherein adjusting the second set screw forward decreases a spacing distance between the lever arm portion and the spring pin, and wherein adjusting the second set screw rearward increases a spacing distance between the lever arm portion and the spring pin.

18. The release aid of claim 15, wherein the lever arm portion includes an activating arm portion protruding inward from the pivot point formed by the axle pin, wherein the activating arm portion is aligned with the spring pin, and wherein the second set screw is arranged in the activating arm portion.

* * * * *